US007735641B2

(12) United States Patent
Agarkov

(10) Patent No.: US 7,735,641 B2
(45) Date of Patent: Jun. 15, 2010

(54) VESSELS FOR MULTICOMPONENT PRODUCTS

(76) Inventor: Andrey Vyacheslavovich Agarkov, Kuybisheva Street, d. 80/2, kv. 41, Yekaterinburg, Sverdlovskay oblast (RU) 620100

( * ) Notice: Subject to any disclaimer, the term of this patent is extended or adjusted under 35 U.S.C. 154(b) by 234 days.

(21) Appl. No.: 10/595,588

(22) PCT Filed: Oct. 26, 2004

(86) PCT No.: PCT/RU2004/000423

§ 371 (c)(1),
(2), (4) Date: Apr. 28, 2006

(87) PCT Pub. No.: WO2005/039988

PCT Pub. Date: May 6, 2005

(65) Prior Publication Data

US 2007/0138032 A1 Jun. 21, 2007

(30) Foreign Application Priority Data

| | | |
|---|---|---|
| Oct. 28, 2003 | (RU) | 2003131460 |
| Oct. 28, 2003 | (RU) | 2003131658 |
| Apr. 28, 2004 | (RU) | 2004112902 |
| May 20, 2004 | (RU) | 2004115213 |
| May 20, 2004 | (RU) | 2004115349 |

(51) Int. Cl.
*B65D 25/08* (2006.01)
*B65D 71/00* (2006.01)

(52) U.S. Cl. ..... 206/219; 206/222; 206/568

(58) Field of Classification Search ..... 206/219–222, 206/568

See application file for complete search history.

(56) References Cited

U.S. PATENT DOCUMENTS

| | | | | |
|---|---|---|---|---|
| 3,856,138 | A * | 12/1974 | Maekawa et al. | 206/221 |
| 3,924,741 | A * | 12/1975 | Kachur et al. | 206/221 |
| 4,315,570 | A * | 2/1982 | Silver et al. | 206/221 |
| 5,330,048 | A * | 7/1994 | Haber et al. | 206/221 |
| 5,725,896 | A * | 3/1998 | Banks | 426/112 |
| 5,971,140 | A * | 10/1999 | Frutin | 206/222 |
| 6,293,433 | B1 * | 9/2001 | Joulia | 222/129 |
| 6,435,341 | B1 * | 8/2002 | Nobbio | 206/219 |
| 6,513,650 | B2 * | 2/2003 | Mollstam et al. | 206/222 |
| 6,561,232 | B1 * | 5/2003 | Frutin | 141/9 |
| 2002/0020637 | A1 * | 2/2002 | De Laforcade | 206/219 |

FOREIGN PATENT DOCUMENTS

| | | |
|---|---|---|
| RU | 2126356 C1 | 6/1995 |
| RU | 2146641 C1 | 7/1996 |
| WO | 9721605 A1 | 6/1997 |

* cited by examiner

*Primary Examiner*—Ehud Gartenberg
*Assistant Examiner*—Jose S Stephens, III
(74) *Attorney, Agent, or Firm*—Caesar, Rivise, Bernstein, Cohen & Polotilow, Ltd.

(57) ABSTRACT

The vessel for multicomponent products contains a receptacle for a basic component, a cover in a detachable connection with the receptacle, a container for an introduced component, which is placed in the upper part of the receptacle. wherein the vessel has at least one channel for output of an end product, the container contains at least one opening, a valve closing the opening of the container, wherein the container and the valve are slidably connected such that either the container or the valve or both can move along the guide members and wherein the cover can interact with the container or the valve.

25 Claims, 4 Drawing Sheets

VESSELS FOR MULTICOMPONENT PRODUCTS

BACKGROUND OF THE INVENTION

1. Field of Invention

The Invention refers to containers utilizing several components different in structure and/or in their aggregative state, mixed immediately before use to be preserved for a long period of time and to create the effect of freshly-prepared food products, healthcare products, cosmetics, chemical agents, etc.

2. Previous Level of Engineering

Different types of the design of vessels intended for storage of various substances and their mixtures in given proportions are widely known in science and technology.

Thus, for example, it is known a device of a bottle cover for dosed introduction of liquid or solid substances into a liquid (U.S. Pat. No. 6,561,232; IPC B65B 03/04; published 13 May 2003), consisting of a container for a basic component, a cover with a chamber filled with a substance under pressure, one or more tubular containers filled with a liquid or solid introduced component, the device is also provided with a disrupting element. The above-mentioned device uses a complex multistage system of containers, put into action after the chamber in the cover is depressurized, and the working volume of the introduced component is limited by the construction of the tubular container.

Also known is a device of a separate container (U.S. Pat. No. 3,856,138; IPC B65D81/32C1; published in 1974), representing a vessel consisting of a receptacle and a container, placed concentrically to each other and sealed with a bottom plug of the receptacle. The cover is provided with a threaded joint. The container is structurally designed with an open bottom. Removal of the cover results in that the container connected thereto leaves the sealed joint with the bottom plug, which in turn results in mixing of the components from the container and the receptacle.

This device can be used only if the container is removed from the receptacle, thus, arrangement of the container along the height of the receptacle does not allow to mix the components at the moment of putting the device into operation.

From the technical point of view, the closest prior art to the present invention is the device for mixing fluids and liquids (RU-Patent No. 2146641; IPC B65D81/32; published 29 Jul. 1996), chosen as the prototype, consisting of a receptacle for a liquid with an entry opening, closed with a cover and the second receptacle for a fluid, arranged into the upper part of the first receptacle, the external housing of the second receptacle with a breaking element in the form a pin, the connecting pipe and the drain pipe submerged into a liquid. The specified device operates as follows: initially it is necessary to wind up the cover till it stops, the second receptacle moves downwardly, the pin breaks a membrane of the second receptacle, then the cover must be turned in the opposite direction, the second receptacle moves upwards, the fluid from the second receptacle moves under pressure through the system of channels into the receptacle with a liquid, afterwards it is necessary to remove the empty second receptacle and the external housing with the breaking element. The above-mentioned device is not widely used as it has limited functional capabilities and a rather complex construction. The device can be used only after performing several sequential operations, thereby, the process of mixing up is irreversible, i.e. the user does not have the opportunity to manage the process of mixing the components at his own discretion.

SUMMARY OF THE INVENTION

The aim of the proposed invention is the development of a vessel for multicomponent products, providing for reliability of its construction; easy and secure depressurization of the container with an introduced component; reduction of actions to be performed to activate the mixing process; release of the end-product without the removal of the container; creation of new functional capabilities, allowing to manage the process of mixing up the components. Achievement of the set aims will provide for an easy use of the device, including the possibility to modify parameters of the end product just before using it for its intended purpose.

The set aim is achieved in that the vessel for multicomponent products contains a receptacle for a basic component, a cover having a plug connection with the receptacle, a container for the introduced component arranged in the upper part of the receptacle, provided with at least one channel for the output of the end product; additionally the container is provided with at least one opening; additionally provided is a valve closing the opening of the container; the container and the valve are connected displaceable relative to each other along guide members; the cover can interact with the container and the valve.

The proposed vessel differs from the prototype in that it contains at least one channel for the output of the end product; the container is provided with at least one opening; additionally provided is a valve closing the opening of the container; the container and the valve are connected displaceable relative to each other along the guide members. The cover can be dismounted from the container and it can also be fixedly connected to them.

Provision of at least one opening in the container allows easy and safe depressurization of the container, which does not require breaking of a membrane. Additional installation of the valve on the container, which closes the opening of the container, provides for reliability of the construction, reduction of actions necessary to activate the mixing process. Provision of at least one channel for the removal of the end-product provides for release of the end-product without the removal of the container. Provision of the cover interacting with the container or the valve and connection of the container and the valve displaceable relative to each other along the guide members provides for some new functional capabilities, allowing to manage the process of mixing the components and to modify parameters of the end product just before using it for its intended purpose.

The detachable connection of the cover with the receptacle can be made in the form of a screwed connection, a clamp, etc.

The container can be located inside the upper part of receptacle, and the detachable connection with the cover can be arranged on the receptacle. The container can be located outside of the upper part of the receptacle, and the valve can be arranged inside the container, the detachable connection with the cover is arranged on the container. In case the container is placed outside of the upper part of the receptacle, the valve can be located on the outside of the container and the detachable connection with the cover is arranged on the valve.

The cover interacts with the container or the valve with its inner part which can be flat or in the form of a binding element of any of the known configurations (a push bar, a toothed member, a hub, a cam, a clamp, a plug connector, etc.). The cover can be fixedly connected to the container or the valve, for example, by welding in the form of a one-piece construction or the cover can be set on the valve or the container using expendable fasteners or any other known methods of fixed connection.

The container or the valve, respectively, can be provided with binding elements—push bars, toothed members, hubs, advancing cams, clamps, plug connectors.

In case the valve is arranged outside of the container, the cover fixes the container and the valve through the binding element in a position when the valve closes the opening of the container. When removed, the cover transfers the movement to the container through the binding element.

In case the valve is arranged inside of the container, the cover fixes the container and the valve through the binding element in a position when the valve closes the opening of the container. When the cover is removed, the movement is transferred to the valve through the binding element, the displacement of the valve results in its detachment with the opening of the container.

Displacement of the valve and the container relative to each other can be carried out through indirect action of a spring element placed between the container and the valve. As a spring element any known spring or a gasket can be used, made of any plastic material. The presence of the spring element allows to facilitate the process of removal of the cover due to unclasping of the spring element. Forces arising thereby give an additional movement to the valve, which results in detachment of the valve and the opening of the container. The spring element is preferable in case the inner part of the cover is flat.

Displacement of the valve and the container relative to each other can be carried out through the creation of excess pressure of one of the components. In this case when the cover is removed from the container, the valve and the container are displaced relative to each other, opening the opening of the container.

If the valve is affected by the spring element and/or excess pressure of a component in the container, the cover fixes the container and the valve in position when the valve closes the opening of the container. When the cover is removed, the spring element and/or the excess pressure of the component in the container transfer the movement to the valve, which results in displacement of the valve from the opening of the container.

In case of a fixed connection of the valve with the cover, the cover fixes the container and the valve in a position when the valve closes the opening of the container. When the cover is displaced, the valve is displaced as well. Additional provision of a removable cap into the cover in this case facilitates the use of the proposed device.

The valve can be made in the form of an independent construction or as an element of the receptacle or the container.

Thus, removal or displacement of the cover sets the vessel in the position "open", simultaneously the valve and the container are displaced relative to each other. Displacement of the valve and the container relative to each other results from direct mechanical effect when the cover is connected fixedly with the valve or the container, or through the binding element when the cover is connected to the valve or the container by a detachable connection.

Opening of the container results from the required displacement of the container and the valve relative to each other which is carried out through the guide members.

The guide members can be made in the form of an independent construction or as parts of the receptacle, the container or the valve. The guide members can have any of the known forms, for example, the form of a ring, zigzag, helical, rectilinear, etc.

The introduced component under the influence of its own weight and/or excess pressure enters the receptacle through the opening in the container and is mixed with the basic component.

Excess pressure can be achieved if there is a gas in the container, for example, carbon dioxide. Excess pressure can also be achieved if the hydraulic pressure is created due to the displacement of the valve and the container relative to each other, for example, when the valve and the container are placed relative to each other in accordance with the principle piston—cylinder or in case of the additional installation of blades inside the container and/or inside a part of the valve, closing the opening of the container. Creation of excess pressure can also be achieved using other known methods.

There can be one or several openings in the container. At least, one opening is necessary to realize the process of mixing the components. Provision of other openings can be necessary for the technological purposes.

The introduced component can be in one of the following states: liquid, powder or granules.

In order to improve the homogeneity of mixing blades can be additionally arranged on the parts of the container submerged into the basic component, allowing to organize the flow of liquid components when the container or the valve is displaced. The above-mentioned blades are placed on the outside part of the container and the valve.

The vessel allows two possibilities of mixing the components—complete mixing according to the formula of the manufacturer or dosed mixing according to the formula of the user. The above-mentioned possibilities depend on the form and the position of the valve.

Uncontrolled complete mixing of the components according to the formula of the manufacturer is carried out in case the valve opens the opening of the container when the cover is removed.

Dosed mixing of the components is carried out in case the valve closes the opening of the container when the cover is removed. In case of the latter, having chosen the necessary amount of the introduced component, one can interrupt the process of mixing the components at any time by the removing the cover from the vessel. The valve closes the opening in the body of the container. The amount of the introduced component depends on the period of time during which the vessel is in the position "open". This allows the user to modify parameters of the end product just before using it for its intended purpose.

In case the cover is detachably connected to the container or to the valve removal of the cover results in termination of interaction of the cover with the container or the valve, the container remains in the vessel.

If the cover is fixedly connected to the container or to the valve, the cover can remain on the vessel and the release of the end product is carried out through the channel intended for the output of the end product through the opening in the cover with the removable cap, thereby the container remains in the vessel.

The end-product prepared during mixing is released from the vessel through the channel. The channel can be placed between the receptacle and the container or it can be placed inside the container or inside the valve. In order to facilitate release of the end product from the bottom of the receptacle, the vessel in question can additionally be provided with a tube. In this case the end-product passes through this tube, which reaches the bottom part of the receptacle, and passes into the channel for the output of the end product.

Other variants of realization of the patented invention are such that the end-product can pass through the outlet channel into an additional opening arranged in the cover or through a removable cap arranged on the cover.

Moreover, in order to provide for additional facilitation of the use of the patented vessel the upper part of the container or the valve can be made in the form of a sliding neck.

If the container is carried out with several chambers with introduced components, it is possible to produce more complex multicomponent products. The above-mentioned variants of the proposed technical solution are connected by a common functional purpose and represent particular embodiments of the valve, the container, the cover, of the guide members and their interactions in order to achieve a common technical result—providing for displacement of the valve and the container relative to each other and putting the vessel into operating condition in order to activate the process of mixing the components. The best ways of implementation of the invention Particular variants of the proposed vessel for multicomponent products are described below with references to the enclosed drawings.

The vessel, which is being patented, guarantees the reliability of its design; easy and secure depressurization of the container with an introduced component; reduction of actions to perform to activate the process of mixing up, to reduce the production cost, the possibility to manage the process of mixing up the components depending on the consumer request.

DETAILED DESCRIPTION OF THE PREFERRED EMBODIMENTS

Example No. 1

Figure 1:
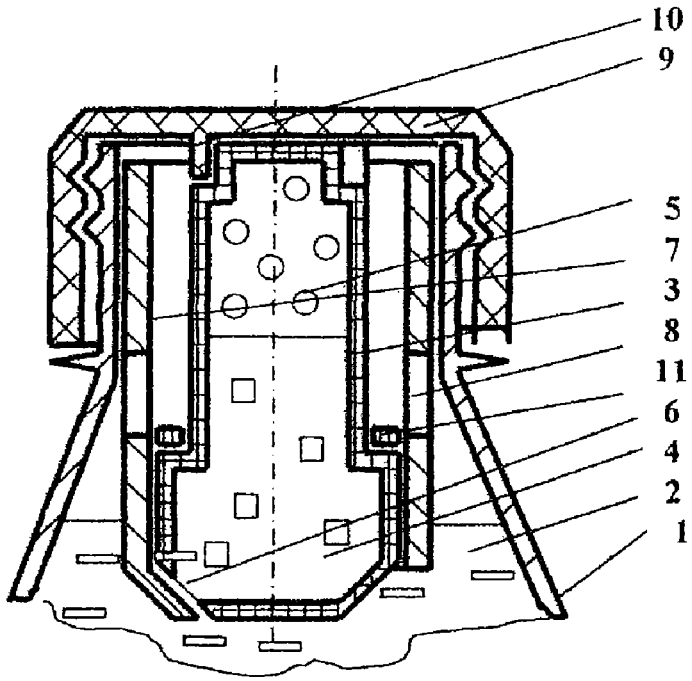
FIG. 1 shows the construction of the proposed vessel in cross-sectional view according to example 1, wherein the valve is placed on the external part of the container, the guide members are made in the form of a ring.

FIG. 1 of the proposed vessel shows the following elements: receptacle (the upper part)—1 with a basic component—2; container—3 with an introduced component—4 and carbon dioxide—5; opening—6 in the container 3; valve—7; channel—8; cover—9; push bar—10; guide members—11 in the form of a ring.

When twisting the cover 9 with detachable connection, the vessel opens and the pressure in the receptacle 1 becomes equal to atmospheric pressure, simultaneously the push bar 10 transfers the movement to the container 3 which displaces along the guide members 11 relative to the valve 7 fixed in the upper part of the receptacle 1. The vessel is set in position "open", unlinking the opening 6 of the container 3 and the valve 7. Under affect of the pressure of carbon dioxide 5 the introduced component 4 is thrown out in the receptacle 1 through the opening 6 of the container 3 and is mixed up with the basic component 2.

If the valve 7 opens the opening 6 of the container 3 when the cover with detachable connection 9 is dismounted, an uncontrolled complete mixing of component 2 and component 4 occurs according to the formula of the manufacturer.

In case if the container 3 is made of transparent materials and the valve 7 closes the opening 6 of the container 3 when the cover with detachable connection 9 is dismounted, dosed mixing of the components occurs. When necessary amount of the introduced component 4 is selected, the user can stop the mixing process of the components by twisting off the cover with detachable connection 9 until it is detached. The container 3 and the valve 7 close the opening 6 of the container 3.

In such a way the user modifies the parameters of the end product just before using it for its intended purpose.

After the cover with detachable connection 9 is dismounted, the end-product can be freely released through the channel 8 formed by the receptacle 1 and the container 3.

Example No. 2

Figure 2:
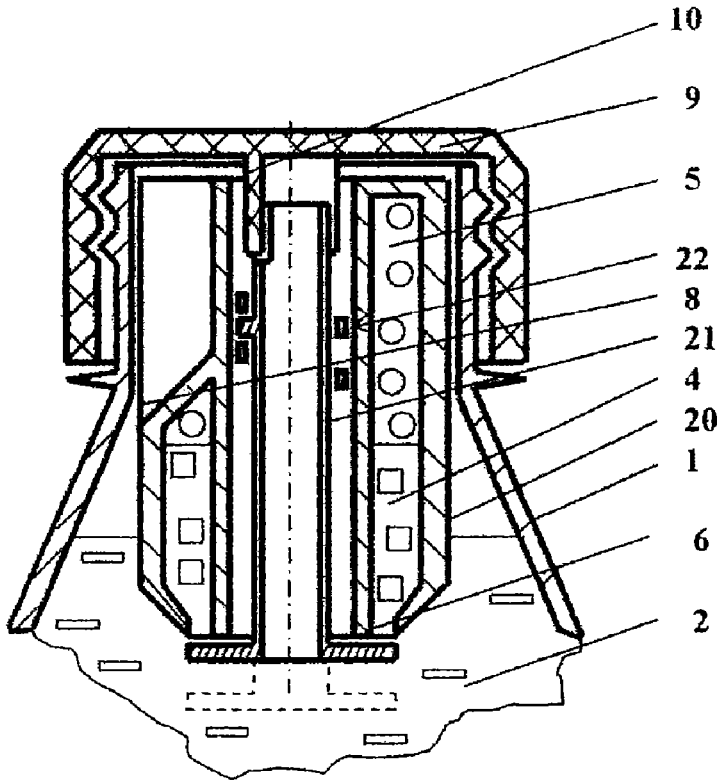
FIG. 2 shows the construction of the proposed vessel in cross-sectional according to example 2, wherein the valve is placed on the inner part of the container, the guide members are made in the form of zigzag.

Another variant of the proposed vessel differs from the vessel according to example No. 1 in particular form of realization and interaction of the container and the valve. FIG. 2 of the proposed vessel shows the following elements: receptacle (the upper part)—1 with a basic component—2; introduced component—4; carbon dioxide—5; opening 6 of the container—20; channel—8; cover with detachable connection—9; push bar—10. This variant differs from variant of example No. 1 in that the guide members—22 have a zigzag form, and the valve—21 is arranged on the inner side of the container—20 which is fixed in the upper part of the receptacle 1.

When being used, the cover with detachable connection 9 transfers the movement through the push bar 10 to the valve 21 which moves along the guide members 22 of the zigzag form and is displaced in a wave-like manner relative to the container 20 fixed in the upper part of the receptacle 1. The vessel is set in position "open", unlinking the opening 6 of the container 20 from the valve 21.

Example No. 3

Figure 3:
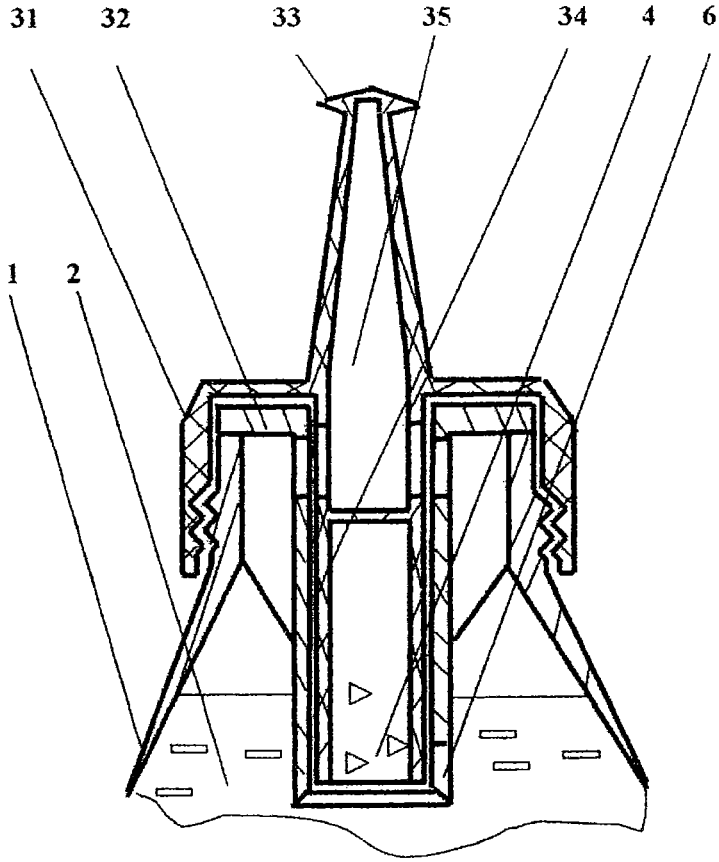
FIG. 3 shows the construction of the vessel in cross-sectional according to example 3, wherein the valve is fixedly connected to the cover, the cover is provided with a removable cap, the guide members are formed by walls of the container and of the valve.

FIG. 3 shows a variant of the vessel for multicomponent products, which differs from variant No. 1 in the particular form of realization and the relative position of the structural elements to each other. FIG. 3 shows the following elements: receptacle (the upper part)—1 with a basic component—2; introduced component—4; cover—31, made with a removable cap 33, valve—34, fixedly connected to the cover 31 and arranged inside the container—32, is the latter fixedly connected to the receptacle 1; valve—35. The construction operates similarly to the previously described variants. Its basic difference from the above-mentioned variants is that the cover with the detachable connection 31 is fixedly connected to the valve 34, so that when the cover 31 is twisted, the container 32 opens. When removing the cap 33 the end-product is released through the channel 35 without dismounting of the cover 31.

Example No. 4

Figure 4:
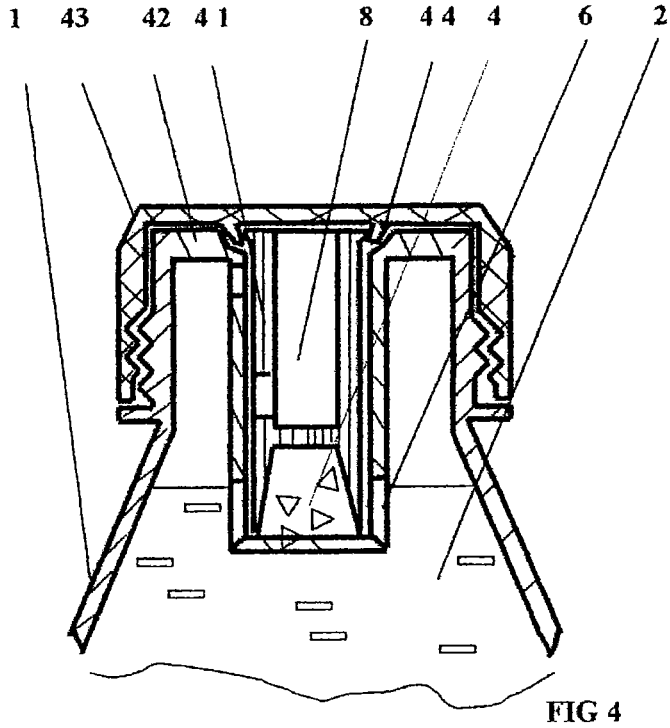
FIG. 4 shows the construction of the vessel in cross-sectional view according to example 4, wherein the container is an element of the receptacle, the upper part of the valve is made in the form of a tube.

FIG. 4 shows a variant of the proposed vessel for multicomponent products. This version of vessel design of contains the valve—41, receptacle—1 with a basic component—2, container—42 which is made as an element of the receptacle—1, cover—43, binding element—44, made in the form of a clamp, introduced component—4, opening—6 of the container 42, channel—8. The basic difference to the variants according to variant No. 1 is that the container 42 is an element of the receptacle 1, the upper part of the valve 41 is made in the form of a neck. When removing the cover 43 the binding element 44 raises the valve 41 above the receptacle 1 which results in unlinking of the valve 41 and the opening 6 of the container 42. The cover 43 is removed, and the valve 41 is fixed in the top position above the receptacle 1. After mixing the components the end-product is released through the channel 8 of the valve 41.

Example No. 5

Figure 5:
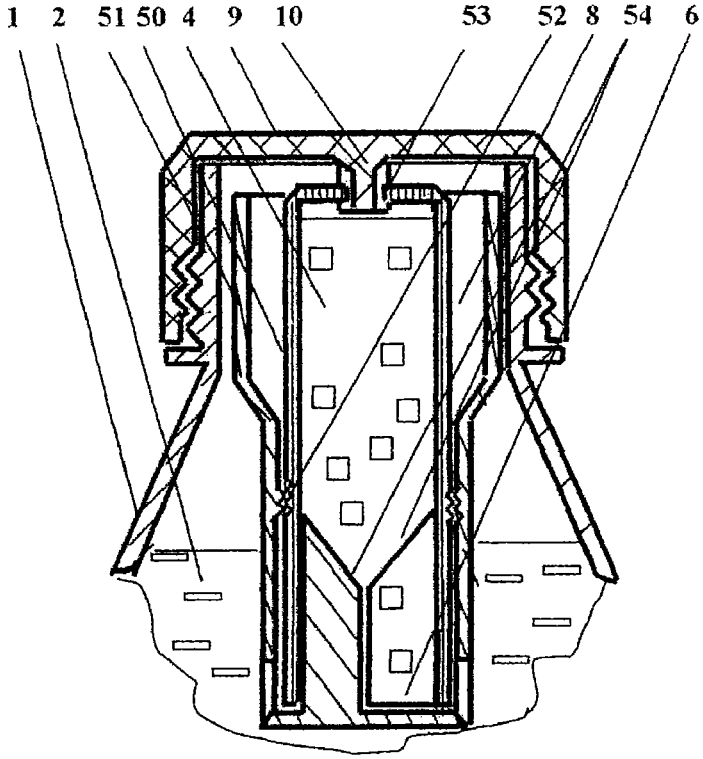
FIG. 5 shows the construction of the vessel in cross-sectional view according to example 5, wherein hydraulic pressure is used resulting from of the displacement of the valve and the container relative to each other.

FIG. 5 shows the variant of the vessel showing a receptacle (the upper part) —1 with a basic component—2, introduced component—4, container 50 with the opening 6; channel—8; cover with a detachable connection—9; push bar—10, valve 51, guide members 52 made on the form of a thread; the upper part of the container 50 is provided with a technological opening—53. The basic difference to the variant of example No. 1 is that in the container 50 and the valve 51 blades 54 are arranged, one of which is connected to the valve 51, and the second is connected to the inner part of the container 50. When the cover 9 is twisted, the valve 51 and the opening 6 of the container 50 are disconnected, simultaneously the introduced component 4 is set under pressure by the blades 54. Under the effect of hydraulic pressure the introduced component 4 is thrown out from the container 50 at high flow speed and is mixed with the basic component 2.

Example No. 6

Figure 6:
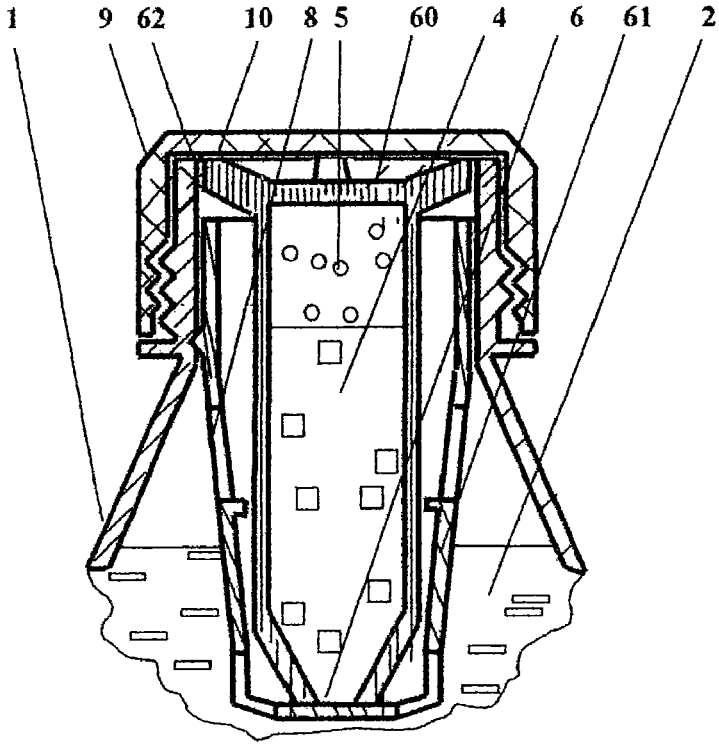
FIG. 6 shows the construction of the declared vessel in cross-sectional view according to example 6, wherein displacement of the container relative to the valve results from the indirect action of pressure of the introduced component.

FIG. 6 shows the variant of the proposed vessel showing a receptacle (the upper part)—1 with a basic component—2; container—60 with an introduced component—4 and carbon dioxide—5; opening 6 in container—60; valve—61; channel—8; a cover with detachable connection—9 the inner part of which is flat; push bar—10; guide members—62.

The present variant of the construction of the vessel differs from the variant No. 1 in a different position and the form of the container 60, the valve 61, and the guide members 62 form a part of the receptacle 1, the introduced component 4 is under pressure from carbon dioxide 5, the push bar 10 is represented by a flat part of the cover 9 and presses the container 60 to the valve 61. Thus, when being used, the cover with detachable connection 9 rises above the receptacle 1 and through the push bar 10 reduces the influence to the container 60 which is under excess pressure of the component 5, the introduced component 4 raises the container 60 along the guide members 62 relative to the valve 61. The vessel is set in position <<open>>, unlinking the opening 6 of the container 60 and the valve 61.

Example No. 7

Figure 7:
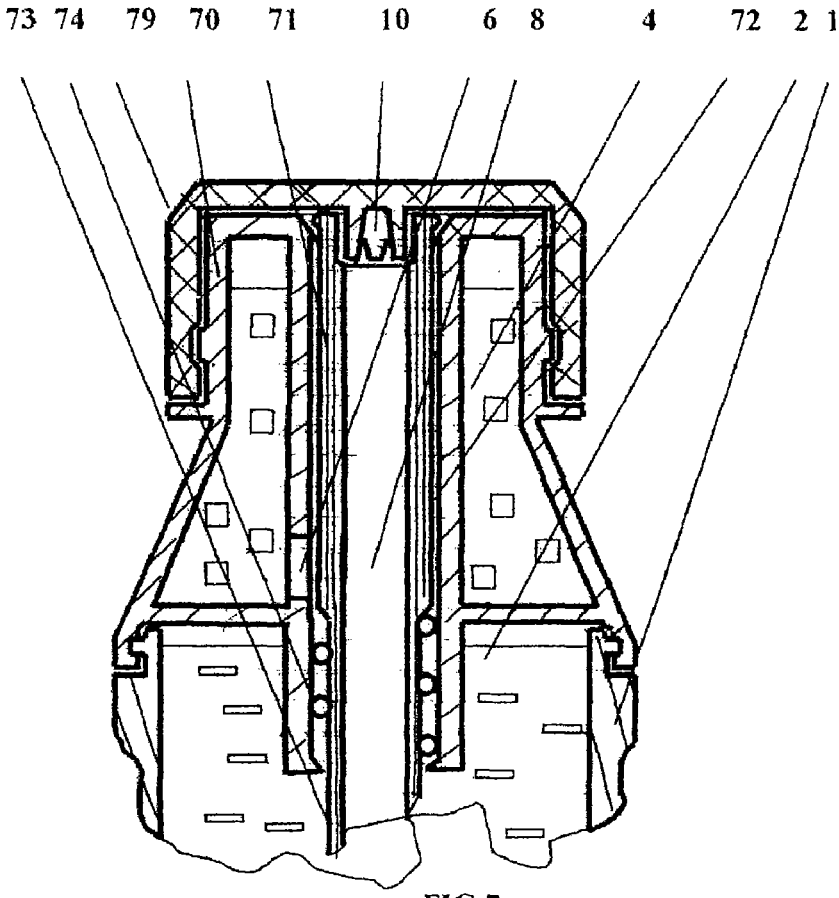
FIG. 7 shows the construction of the vessel in cross-sectional view according to example 7 with the channel for the output of the end product through the valve, connection of the channel with a tube reaching the bottom part of the receptacle, installation of a spring between the container and the valve.

FIG. 7 shows the variant of the proposed vessel for multicomponent products showing: receptacle (the upper part)—1 with a basic component—2; container 70 with introduced component—4; opening 6 in the container—70; channel—8; binding element—10. As distinct from variant No. 1 the present variant in addition to the different form of the container 70 contains a valve 71, a cover 79 with detachable connection in the form of a clamp, guide members 72, spring 74, tube 73 in connection to a channel 8. The container 70 and the valve 71 are located above the receptacle 1, and the guide members 72 are made as part of the sides of the valve 71 and the container 70. The channel for the output of the end product 8 passes through the tube 73 and the valve 71. When in use, through the binding element 10 the cover with detachable connection 79 transfers the movement to the valve 71, which under the influence of the cover 79 and the spring 74 moves along the guide members 72 and displaces upwardly relative to the container 70. The vessel is set in position <<open>>, unlinking the opening 6 of the container 70 and the valve 71.

Example No. 8

Figure 8:
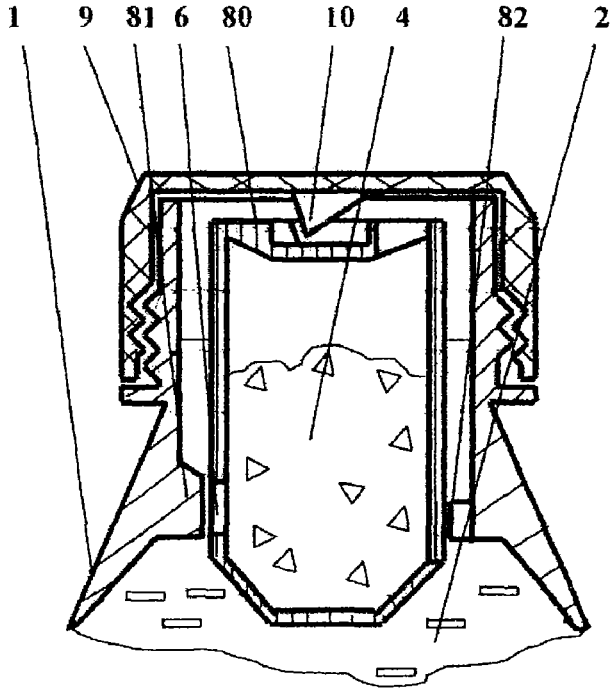
FIG. 8 shows the construction of the proposed vessel in cross-sectional view according to example 8, wherein the channel for the output of the end product is inside the container.

FIG. 8 shows the variant of the proposed vessel for multicomponent products showing: a receptacle (the upper part)—1 with a basic component—2; the container 80 made with an open upper part, an introduced component—4; opening—6 of the container 80; cover with detachable connection—9; push bar—10. As distinct from variant No. 1 the present variant contains a different in its form container 80, a valve 81, guide members 82, introduced component 4 in the form of a powder. When in use the cover with the detachable connection 9 transfers the movement through the push bar 10 to the container 80 which moves along the guide members 82, which provide only rotational movement, and displaces relative to the valve 81. The vessel is set in position <<open>>, unlinking the opening 6 of the container 80 and the valve 81.

The above-mentioned variants of the construction of the vessel for multicomponent products operate similarly to each other. Other possible variants of the proposed vessel are reduced to different combinations of ways of connection of the container and the valve, and the guide members.

INDUSTRIAL APPLICABILITY

The use of the vessel for multicomponent products will provide for improvement of the quality of the latter due to new functional capabilities: reliability of construction; easy and safe depressurization of the container with the introduced component; reduction of actions to activate the mixing process up; release of the end product without the removal of the container.

Furthermore, the appearance of the new functional capabilities providing for management of the mixing process of the components will allow the user to model parameters of the end product just before using it for its intended purpose, taking into account particular circumstances and conditions.

The invention claimed is:

1. A vessel for multicomponent products comprising:

a receptacle for a basic component;

a cover in a detachable connection with the receptacle;

a container for an introduced component, the container placed in an upper part of the receptacle, wherein the vessel has at least one channel for outputting an end product and the channel is located between the inner side of the receptacle and the outside of the container;

at least one opening in the container;

a valve closing the opening of the container, wherein the container and the valve are slidably connected such that either the container or the valve or both can move along guide members and wherein the cover immobilizes the container.

2. The vessel for multicomponent products of claim 1, wherein the valve is provided on an outer surface of the container.

3. The vessel for multicomponent products of claim 1, wherein the valve is provided on an inner surface of the container.

4. The vessel for multicomponent products of claim 1, wherein the guide members are formed by a part of the receptacle for the basic component or by the walls of the container and the valve.

5. The vessel for multicomponent products of claim 1, wherein the container is made as an independent structural element or as an element of the receptacle.

6. The vessel for multicomponent products of claim 1, wherein the valve is made either as an independent structural element, as an element of the receptacle, or as an element of the container.

7. The vessel for multicomponent products of claim 1, wherein the cover is connected to the container or to the valve with the possibility of a detachable connection.

8. The vessel for multicomponent products of claim 1, wherein the cover is rigidly connected to the container or the valve.

9. The vessel for multicomponent products of claim 1, further comprising a resilient element for the interaction of the cover with the valve or the container.

10. The vessel for multicomponent products of claim 1, wherein the guide members are in a form of a ring, zigzag, spiral, or have a rectilinear form.

11. The vessel for multicomponent products of claim 2, wherein the upper part of the valve is made in the form of a neck.

12. The vessel for multicomponent products of claim 2, further including blades mounted on the inside part of the container and the valve.

13. The vessel for multicomponent products of claim 3, wherein the upper part of the valve is made in the form of a neck.

14. The vessel for multicomponent products of claim 3, further comprising blades mounted on the inside part of the container and the valve.

15. The vessel for multicomponent products of claim 7, wherein a cover interacts with the container or the valve by its inner part.

16. The vessel for multicomponent products of claim 7, wherein a coupling element is mounted on the container or on the valve.

17. The vessel for multicomponent products of claim 7, further comprising a resilient element for the interaction of the cover with the valve or the container.

18. The vessel for multicomponent products of claim 8, wherein a removable cap is arranged on the cover.

19. The vessel for multicomponent products of claim 8, further comprising a resilient element for the interaction of the cover with the valve or the container.

20. The vessel for multicomponent products of claim 8, wherein a cover interacts with the container or the valve by its inner part.

21. The vessel for multicomponent products of claim 8, wherein a coupling element is mounted on the container or on the valve.

22. The vessel for multicomponent products of claim 15, wherein the inside part of the cover is flat.

23. The vessel for multicomponent products of claim 15, wherein the inside part of the cover has a coupling element.

24. The vessel for multicomponent products of claim 23, wherein the coupling element is made in the form of a push bar, a toothed member, a hub, a cam, a clamp, or a plug connector.

25. The vessel for multicomponent products of claim 16, wherein the coupling element is made in the form of a push bar, a toothed member, a hub, a cam, a clamp, or a plug connector.

* * * * *